United States Patent [19]

Ibrahim

[11] 4,299,092

[45] Nov. 10, 1981

[54] ENERGY CONSERVING REFRIGERATED MERCHANDISER DISPLAY CASE

[75] Inventor: Fayez F. Ibrahim, Niles, Mich.

[73] Assignee: Tyler Refrigeration Corporation, Niles, Mich.

[21] Appl. No.: 167,727

[22] Filed: Jul. 11, 1980

Related U.S. Application Data

[63] Continuation-in-part of Ser. No. 145,712, May 1, 1980, said Ser. No. 141,359, said Ser. No. 141,360, each is a continuation-in-part of Ser. No. 101,069, Dec. 7, 1979, Pat. No. 4,265,090.

[51] Int. Cl.[3] ..... F25B 41/00; A47F 3/04; F25D 23/02

[52] U.S. Cl. ..... 62/81; 62/256; 62/265; 62/411; 62/418

[58] Field of Search ..... 62/255, 256 X, 411 X, 62/417, 418 X, 427, 151, 265 X, 428, 419, 80, 81

[56] References Cited

U.S. PATENT DOCUMENTS

| | | | |
|---|---|---|---|
| 2,558,997 | 7/1951 | Voelker | 62/255 X |
| 2,960,844 | 11/1960 | Quick | 62/408 X |
| 3,006,166 | 10/1961 | Kronenberger et al. | 62/418 X |
| 3,139,737 | 7/1964 | Wile | 62/256 |
| 3,226,945 | 1/1966 | Spencer | 62/256 |
| 3,369,375 | 2/1968 | Gerweck et al. | 62/411 X |
| 3,371,503 | 3/1968 | Perez | 62/256 |
| 3,403,525 | 10/1968 | Beckwith et al. | 62/256 X |
| 3,465,536 | 9/1969 | Vogel et al. | 62/255 X |
| 3,756,038 | 9/1973 | MacMaster et al. | 62/256 |
| 3,850,003 | 11/1974 | Beckwith et al. | 62/256 X |
| 3,937,033 | 2/1976 | Beckwith et al. | 62/256 X |
| 4,026,121 | 5/1977 | Aokage et al. | 62/151 |
| 4,144,720 | 3/1979 | Subera et al. | 62/256 |
| 4,145,893 | 3/1979 | Vogel | 62/255 X |
| 4,182,130 | 1/1980 | Ljung | 62/256 X |

*Primary Examiner*—Lloyd L. King

*Attorney, Agent, or Firm*—LeBlanc, Nolan, Shur & Nies

[57] ABSTRACT

An improvement in refrigerated display cabinets in which barrier doors and one or more guard air bands protect the primary refrigerated air band which is circulated within the cabinets during time periods when the barrier door is opened. The cabinets may be equipped with air defrost systems. When two guard air bands are employed, the outermost of these is directed across the outside surface of the barrier door. The air defrost system can incorporate a door opening mechanism which provides a gap between the barrier door and the access opening in order to permit ambient air through-flow for defrost purposes.

Control circuitry can be controlled by opening of the barrier doors in order to actuate the guard air band movement.

61 Claims, 10 Drawing Figures

70
74
138
144
142
122
78
80
134
136
112
126
82
120
A
94
110
92
100
102
104
106
156
72
90
150
148
158
160
140
146
124
98
108
130
96
132
154
114
84
128
116
118
76
86
88
152

10
14
12
32
36
34
18
38
60
64
52
20
A
40
44
46
48
50
58
54
42
66
68
62
16
56
22
26
24
30
28
Ambient air
65°F to 75°F
0.01 Lb. water / Lb. dry air
Refrigerated air band A
−15°F to −25°F
0.0002 Lb. water / Lb. dry air

ENERGY CONSERVING REFRIGERATED MERCHANDISER DISPLAY CASE

RELATED APPLICATIONS

The present application is a continuation-in-part of the inventor's copending applications entitled ENERGY EFFICIENT GLASS DOOR MERCHANDISER, Ser. No. 145,712 filed May 1, 1980; REFRIGERATED MERCHANDISER DISPLAY CASE ADAPTED FOR ENERGY CONSERVATION Ser. No. 141,359 and REFRIGERATED MERCHANDISER DISPLAY CASE Ser. No. 141,360 both filed Apr. 18, 1980 which are both, in turn, continuation-in-part applications of an application entitled GLASS DOOR MERCHANDISER WITH AMBIENT AIR DEFROST, Ser. No. 101,069 filed Dec. 7, 1979, U.S. Pat. No. 4,265,090. The disclosures of all of these applications are hereby incorporated by reference as though fully set forth herein.

BACKGROUND OF THE INVENTION

The present invention relates to a "reach-in" merchandiser type of refrigerated display case or cabinet used primarily in retail food and supermarket outlets. The term "refrigerated", in accordance with the present invention is intended to incorporate those cases maintained at a temperature at or in excess of 32° F., such as display cases utilized for the display of milk and fresh foods, and those cases maintained below 32° F., such as frozen food cases. In addition, references are made herein to the use of transparent doors, since those are the types of doors most frequently utilized in such retail outlets. Other types of doors could also be employed within the scope of the present invention.

An increasing market demand made by managers of retail food outlets is to reduce the energy consumption of refrigerated display cabinets in order to reduce operating costs wherever possible. Various approaches have been used to conserve the energy required to operate these display cases. When the display case is operated as an open-front or an open-top cabinet to permit freer customer access to the stored products the primary refrigerated air band circulated within the cabinet is often protected by one or more outer air bands such as disclosed in U.S. Pat. No. 4,144,720 issued to Subera, et al which is assigned to the same assignee as the present application. In the Subera patent, an open-front refrigerated display case having primary and secondary air conduits is disclosed. An additional ambient air curtain is provided so that the refrigerated air band is protected by two outer air bands flowing in the same direction across the open access area of the case. Another approach to conserve operating energy has been to install barrier doors in order to limit the contact of ambient air with the refrigerated air band to those time periods during which customers or employees hold open the barrier doors. This type of refrigerated display cabinet is shown in U.S. Pat. No. 4,072,488 to Johnston and in the above referred to copending applications of the inventor hereof.

it has not been deemed necessary to protect the refrigerated air band additionally from exposure to ambient air during those time periods when the barrier door is opened. Consequently, the prior art refrigerated display cabinets having barrier doors have been constructed for single air band operation, whereas the open-front and open-top refrigerated cases have been constructed with multiple bands in order to protect the refrigerated air band from contact with ambient air.

This invention is based on recognition that an energy conserving refrigerated display case can utilize both a barrier door and multiple air bands to better provide protection for the primary refrigerated air band. If these diverging solutions to the problems of energy conservation are utilized in a unique manner operating costs can be lowered due to the energy saved.

In the operation of all types of refrigerated display cabinets, it is desirable to include a system for automatically defrosting the refrigeration coils. The defrost cycle can be actuated either at set periodic time intervals or when the frost buildup within the system has reached a certain predetermined level. Such systems are typically thermostatically controlled so as to switch from a refrigeration cycle to a defrost cycle of operation. In this manner of operation it is possible to avoid any significant frost buildup within the display cabinet such that inoperability and spoilage of food products would occur.

There have been three different approaches for defrosting refrigerated display cabinets in this art. These are, utilizing the electric resistance heaters; passing a compressed refrigerant gas having a high specific heat through the refrigeration coils; and, circulating ambient air through an air conduit in which the refrigeration coils are positioned. Due to the increased cost of energy, efforts have been made to place more emphasis on the utilization of ambient air defrost systems as an alternative to the electrical resistant heaters or compressed refrigerant gas defrost systems.

The present invention based on using both a barrier door and multiple air bands in a refrigerated display cabinet is usable with each of these three different defrosting approaches. In particular, the energy conserving refrigerated display case of the present invention provides for a defrost cycle in which ambient air is circulated through an air conduit in which the refrigeration coils are positioned in order to achieve lower operating costs. One energy efficient way to defrost a cabinet using ambient air is to create a gap between the barrier door and its associated access opening in order to provide for through-flow of ambient air in order to defrost the refrigeration coils. The apparatus and method involved in creating such a flow path for ambient air during a defrost cycle are described and claimed in the above referred to copending applications.

In those refrigerated cabinets having single refrigerated air bands protected by glass barrier doors, the refrigerated air band may have a temperature as low as about −25° F. and a humidity ratio of 0.0002 lbs. water/lb. dry air. Upon opening the barrier door to gain access to the displayed products, this air band comes in contact with ambient air which can have a temperature as high as about 75° F. and a 55% relative humidity which involves a humidity ratio of 0.01 lbs. water/lb. dry air. The temperature difference upon opening the barrier door is then about 100° F. and the humidity ratio difference is approximately 0.0098 lb. water/lb. dry air. This type of contact can result in considerable heat transfer to the refrigerated air band both in the form of heat exchange between the moving air band and the stationary ambient air and by mass transfer of moisture which adds to the refrigeration energy required for operation of the display cabinet since that moisture must be condensed in the form of frost or ice. The heat of condensation for that moisture must be extracted by the refrigeration apparatus. This type of heat trsansfer can raise the refrigeration load in a cabinet even above that required by multi-air band open-front cases having no barrier doors. To solve this problem, one or more air bands can be provided to protect the primary refrigerated air band against direct contact with ambient air during those times when the merchandiser doors are opened.

The problem of protecting refrigerated air bands against contact with the ambient air has been solved in other ways using curtains which do not permit for the low energy air defrost systems or do not permit customer entry. Beckwith et al, U.S. Pat. No. 3,403,525 discloses a night curtain which is to be placed over the normally open access area of a refrigerated case in order to reduce energy consumption during the "nonsales" hours, but with this arrangement no air defrost or customer entry is possible. Vogel, U.S. Pat. No. 4,117,698 discloses a retractable night curtain for use during closed store hours during which no provision is made for customer entry.

In designing refrigerated display cabinets to be defrosted by ambient air, a number of different systems have been employed. One type of system which employs ambient air during a defrost cycle is exemplified by U.S. Pat. Nos. 3,403,525; 3,850,003 and 3,937,033, all to Beckwith et al. These systems use fans separate and distinct from the main circulating fans to move ambient air across the refrigeration coils for defrosting. The additional fans are turned on only during the defrost cycle of operation for pulling ambient air from outside of the display cabinet directly into the air conduits located within the walls of the cabinet. A second type of system is illustrated in U.S. Pat. No. 3,082,612 to Beckwith, which system draws ambient air into the main circulation path through ports located in the lower front panel of the refrigerated display cabinet. Such ports are normally closed during the refrigeration cycle and opened during the defrost cycle. The Beckwith et al, U.S. Pat. No. 3,850,003 patent indicates that the concepts described in patent Nos. 3,082,612 and 3,403,525 did not prove to be practical and hence were not commercially feasible.

Some of the above-noted patents directed to air defrost systems use reverse air flow, during the defrost cycle of operation. In these ambient air can easily be drawn through the access opening of the case or cabinet into the air conduit through the outlet opening of the air conduit and then expelled from the air conduit after the defrost operation through the unblocked access opening. Such an arrangement, however, can not be readily used in a refrigerated merchandiser display case having barrier doors, since the front opening in the cabinet is covered by the doors. Thus, in order to employ an ambient air defrost system, a different type of system had to be conceived.

In seeking to employ ambient air defrost techniques in cases having doors, systems have been developed for drawing air through a limited portion of the air conduit by opening flaps into the conduit, which flaps are arranged as so to straddle the evaporator coils of the refrigeration mechanism. Such systems are disclosed in U.S. Pat. No. 3,226,945 to Spencer and U.S. Pat. No. 4,072,488 to Johnston. The patent to Spencer illustrates a plurality of different embodiments of open-top refrigerated display cases, both of the single shelf and multi-shelf types, in which the air flow is always drawn over evaporator coils in a single direction under negative pressure. During the refrigeration cycle of operation, air after being refrigerated is circulated through the air conduit and into the display section of the case. The patent to Johnston discloses a glass door type merchandiser display cabinet in which air is circulated through the air conduit and through the evaporator coils arranged within the air conduit in such a direction that cold air enters the display space at the bottom of the cabinet and is then drawn up into the air inlet located near the top of the cabinet. For defrosting, top flaps are opened since this case is designed with coils at the top. This shows a somewhat complicated way to provide both glass doors and air defrost features according to the prior art. Such systems are relatively complex and can involve certain operational problems, particularly due to frost and dust accumulation. Where there are moving parts inside of the air conduit an accumulation of frost on such parts can cause them to stick and hence not function properly.

SUMMARY OF THE INVENTION

An improvement in refrigerated display cabinets is provided in which barrier doors and one or more guard air bands protect the primary refrigerated air band during time periods when the barrier door is opened to permit access to the displayed products. Provision is also made for air defrost of the refrigeration means within the cabinet.

When a single guard air band is employed, it is activated for movement only during those time periods when the barrier door is opened. When two guard air bands are employed, the outermost of these is directed across the outside surface of the barrier door and can run continuously or only during those time periods when the access door is opened in order to achieve low energy consumption operation of the cabinet.

Air defrost for the cabinet having a barrier door positioned across the access port is achieved by providing an air defrost means which functions to selectively create a gap between the barrier door and the associated access opening in order to effect defrosting in a simple and low energy consumption manner.

It is therefore, an object of the present invention to provide an improved energy conserving refrigeration display cabinet having both one or more barrier doors and one or more guard air bands.

Another object of the present invention is to provide an energy conserving refrigerated display cabinet of the above type with an air defrost means which selectively creates a gap between a barrier door and the access opening covered by the door in order to provide for ambient air passage through the cabinet for defrosting purposes.

Specific preferred embodiments of the invention will be described below with reference to the appended drawing figures.

DESCRIPTION OF THE PREFERRED EMBODIMENTS

Figure 1:
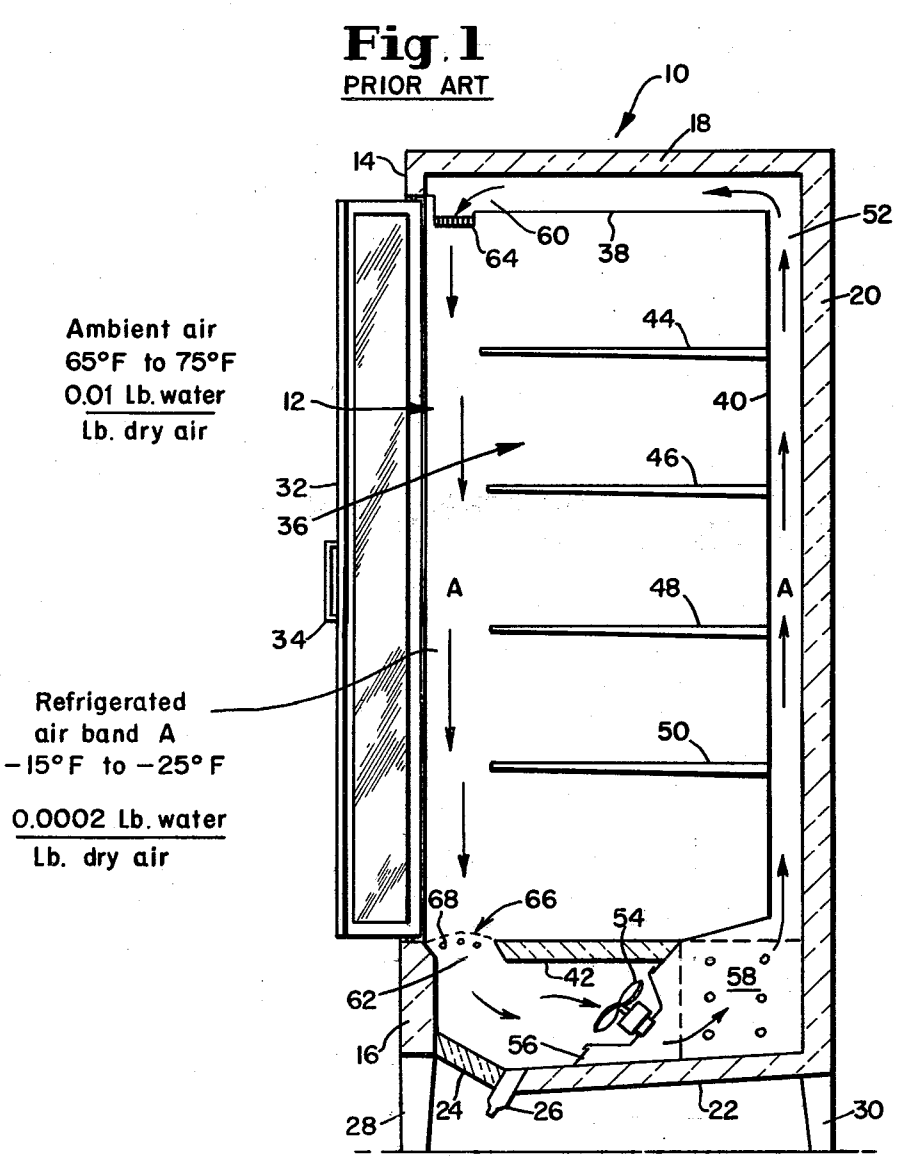
Fig. 1 PRIOR ART
FIG. 1 is a side cross-sectional schematic view of a refrigerated display cabinet of the prior art wherein a single refrigerated air band is circulated within a cabinet having a barrier door.

Referring now to FIG. 1, a refrigerated display cabinet 10 of the type found in the prior art is shown. An access opening 12 is formed in the front side thereof between upper front wall 14 and lower front wall 16. Upper front wall 14 is connected to top wall 18 which is, in turn, connected by the rear edge thereof to rear wall 20. A bottom panel 22 is connected between the lower edge of rear wall 20 and the bottom of lower front wall 16 with an inclined bottom panel 24 interposed to provide for a bottom drain 26. Support legs 28 and 30 are also shown.

A barrier door 32 is positioned for pivotally opening away from access opening 12. A handle 34 is provided for that purpose. A display space 36 is defined by the inner surface of door 32 and a top inner wall 38, a rear inner wall 40 and a bottom inner panel 42. Product display shelves 44, 46, 48 and 50 are provided within display space 36 and attached to rear inner panel 40 as shown. A refrigerated air band conduit 52 is formed by the spacing of the outer walls away from the inner walls 38, 40 and 42. A motor-driven fan 54 is positioned within the bottom portion of conduit 52 by means of a bracket 56. A refrigeration means consisting of an evaporator coil set 58 is also shown positioned adjacent to fan 54. This evaporator coil set 58 is designed to permit a free flow of refrigerated air therethrough as shown by the air flow arrows which move through the perforations shown in element 58. The motor-driven fan 54 causes the refrigerated air band A to move in a counterclockwise direction and to form a refrigerated air curtain between the inner surface of door 32 and the left ends of the product shelves 44–50. This refrigerated air curtain extends from the upper air conduit outlet 60 to the bottom inlet 62. The outlet 60 has downwardly directed louvers 64 positioned therein and the inlet 62 has a grille 66 positioned thereacross to permit unimpeded air flow. If necessary, electrical or refrigerant fluid heater lines 68 can be formed as part of the grille 66 in order to prevent moisture condensation and frost build-up thereon.

When door 32 is opened, the refrigerated air curtain A which is operated in many cabinets as a temperature of from −15° F. to −25° F. comes in contact with the ambient air which is at a temperature of from about 65° F. to 75° F. The flow of heat from the warmer ambient air to the refrigerated air band is substantial during those time periods when barrier door 32 is opened. In addition to the molecular heat transfer, the higher moisture content in the ambient air is transferred by mass diffusion into the relatively dry refrigerated air band A. For example, the ambient air can have a humidity ratio of about 0.01 lbs of water per pound of dry air whereas the refrigerated air band can have a humidity ratio of about 0.002 lbs of water per pound of dry air. Thus, the temperature differential between the contacting air streams ranges from about 80° F. to 100° F. and the humidity ratio difference in the example given is 0.008 lbs. of water per pound of dry air. This moisture content differential is sufficient to cause considerable mass transfer of water molecules into the refrigerated air band.

The present invention decreases the temperature differential and the subsequent heat transfer through both thermal contact and moisture mass transfer between the refrigerated air band and ambient air by interposing one or more air guard bands therebetween when the door 32 is open for product access.

Figure 2:
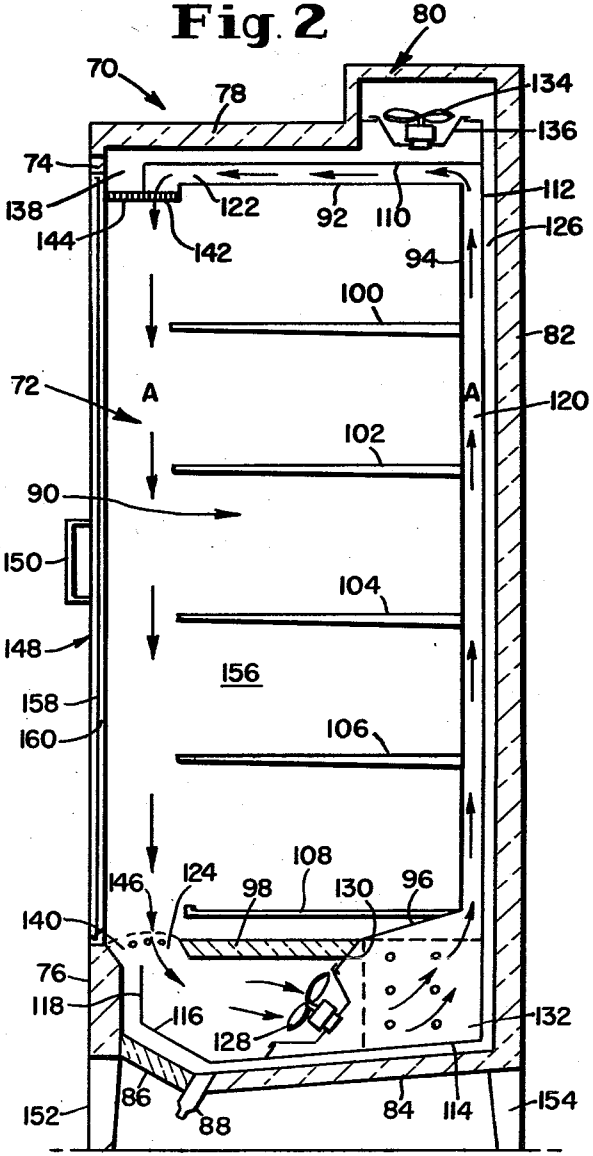
FIG. 2 is a side cross-sectional schematic view of a refrigerated display cabinet having multiple-circulated air bands and a glass barrier door shown in closed position.
Figure 3:
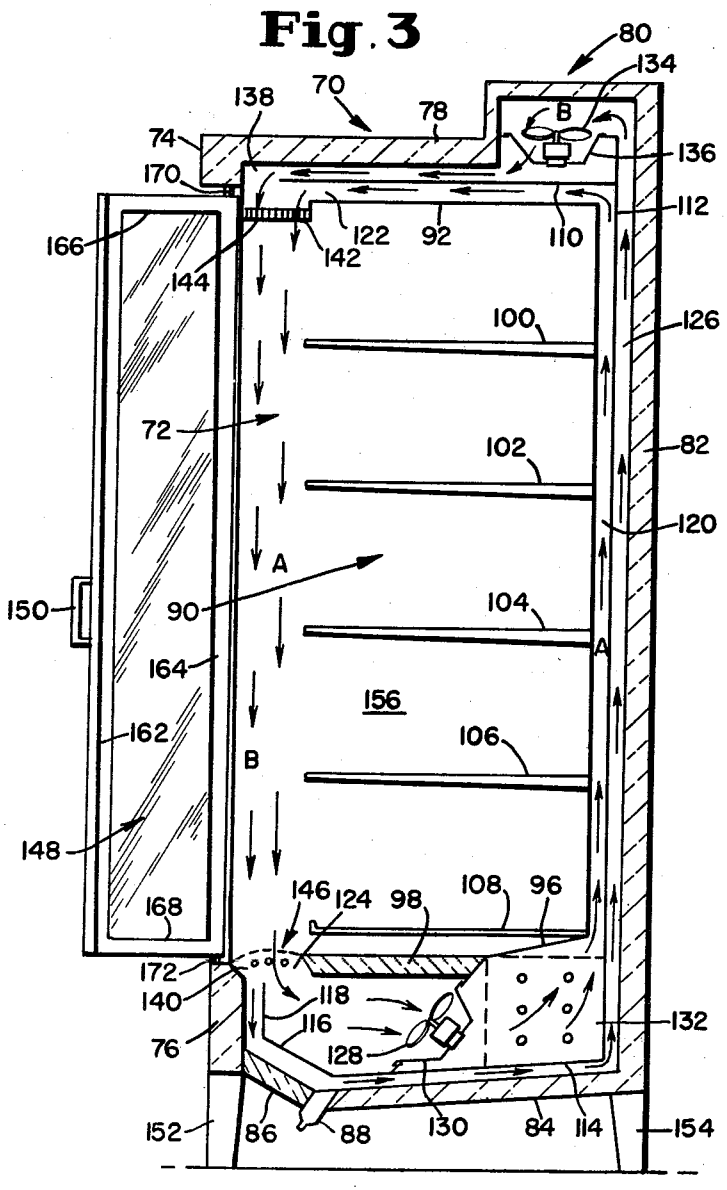
FIG. 3 is a schematic view of the refrigerated display cabinet illustrated in FIG. 2 showing the barrier door in an open position.

Referring now to FIGS. 2 and 3, a refrigerated display cabinet 70 according to the present invention has an access opening 72 formed between the upper front wall 74 and the lower front wall 76. Upper front wall 74 is connected to top wall 78 which is in turn connected to a secondary fan housing 80. This fan housing is connected by the rear edge thereof to rear outer wall 82 which joins a bottom panel 84 at the lower edge thereof. The front edge of bottom panel 84 is connected to an inclined bottom panel 86 and a condensate drain 88 is provided at the juncture of these two bottom panels.

A display space 90 is formed within refrigerated display cabinet 70 by inner top wall 92 which is connected by the rear edge thereof to inner rear wall 94 which is, in turn, connected to an inclined bottom wall 96 at the lower edge thereof. Bottom wall 96 is in turn connected to a horizontal bottom wall 98. A series of product support shelves 100, 102, 104, 106 and 108 are provided within display space 90 and attached to inner rear wall 94. A top divider panel 110 is positioned between top wall 78 and top inner wall 92 and is connected by the rear edge thereof to vertical divider panel 112 which extends downwardly between rear wall 82 and rear inner wall 94 and is connected at its bottom edge to bottom divider panel 114 which extends forward toward front wall 76 and connects to an inclined divider panel 116 which is, in turn, connected to a vertical divider panel 118. The inner walls 92, 94, 96 and 98 are spaced from divider panels 110, 112, 114, 116 and 118 in order to form a first air band conduit 120 which extends from an outlet opening 122 at the top portion thereof in a clockwise direction to an inlet opening 124 located adjacent to bottom inner wall 98. A second air band conduit 126 is formed between the divider panels 110, 112, 114, 116 and 118 and the outer walls 78, 82, 84 and 86.

A motor-driven fan 128 is located in the first air band conduit 120 and is positioned therein by a bracket 130 adjacent to a refrigeration system evaporator coil box 132 which is designed to permit the through-flow of air circulated by fan 128. A second air circulation means is provided for in the second air band conduit 126 by motor-driven fan 134 which is supported in fan housing 80 by a bracket 136. The second air band conduit 126 has an outlet opening 138 at the top most portion thereof and an inlet opening 140 located near bottom inner wall 98. Both of the first and the second air conduit outlets 122 and 138 have downwardly directed louvers 142 and 144 positioned therein, respectively. Inlet openings 124 and 140 have a common air grille 146 positioned to cover both of said openings.

A barrier door 148 is provided for substantially covering access opening 72 and a handle 150 is provided for opening door 148 which is pivotally mounted in the front wall of display cabinet 70 between upper front wall 74 and lower front wall 76. Support legs 152 and 154 are also provided. Display cabinet 70 has one end wall 156 also shown.

In operation, when door 148 is closed as illustrated in FIG. 2, the second air circulation means 134 is inactive and only the refrigerated primary air band A is circulated within the first air band conduit 120 by the first air circulation means 128 through the evaporator coil set 132. So long as door 148 remains closed, the illustrated refrigerated display cabinet can be operated in a low energy consumption fashion. For this purpose, the outer walls are insulated as shown and the barrier door 148 is composed of 2 or more glass panels 158 and 160 in order to provide an insulating air space therebetween.

As shown in FIG. 3, when barrier door 148 is opened an actuating means (shown in FIG. 7) is activated to cause the second air circulating fan 134 to circulate air in the second air band conduit 126. This action creates a second air guard band B which is then interposed between the refrigerated air curtain A and the ambient air outside of the cabinet, but when the door 148 is closed the actuating means is caused to deactivate the second air circulating means 134 whereby the second air band B is terminated and air does not flow in the second air band conduit 126. As shown in FIG. 3, the refrigerated air band A can operate, for example, at a temperature of −25° F. and a humidity ratio of 0.0002 lbs. water/lbs. dry air. The secondary air band B can operate at a temperature of 30° F. and a humidity ratio of 0.0032 lbs. of water per pound of dry air. The operating temperature range of the primary air band is in the range of −25° F. to about 35° F. whereas the secondary band temperature range is about 10° F. to 40° F. The ambient air outside of the refrigerated cabinet 70 can, for example, be at a temperature of 75° F. and a humidity ratio of 0.01 lbs. water per pound dry air and a relative humidity of 55%. In this manner, the temperature difference between the secondary air band B and the refrigerated air band A is only 55° F. as opposed to 80° F. to 100° F. as described with regard to the prior art shown in FIG. 1 above. The humidity ratio difference between the secondary air band B and the refrigerated air band A is then only 0.003 lbs. water per pound dry air which limits the moisture intake via mass action from the ambient air since such humid air is not in direct contact with the refrigerated air band A. In this example, the temperature difference between the ambient to the secondary band is 45° F. and the humidity ratio difference is 0.0068 lbs. water per pound dry air.

In FIG. 3, barrier door 148 is shown with vertical door frame members 162 and 164 and horizontal upper frame member 166 and lower frame member 168. Hinge pins 170 and 172 are provided at the top and bottom edges, respectively, for supporting door 148 between the top front wall 74 and the bottom front wall 76.

It is also possible to construct cabinet 70 without the bottom divider panels 114, 116 and 118 in order to form a common inlet chamber. With this embodiment more intermingling of the secondary and primary air bands occurs during the operation of the secondary fan 134 when the barrier door is opened. The coils 132 can be defrosted by air flow from both of the bands flowing in reverse direction to that of the primary band during the refrigeration cycle.

Figure 4:
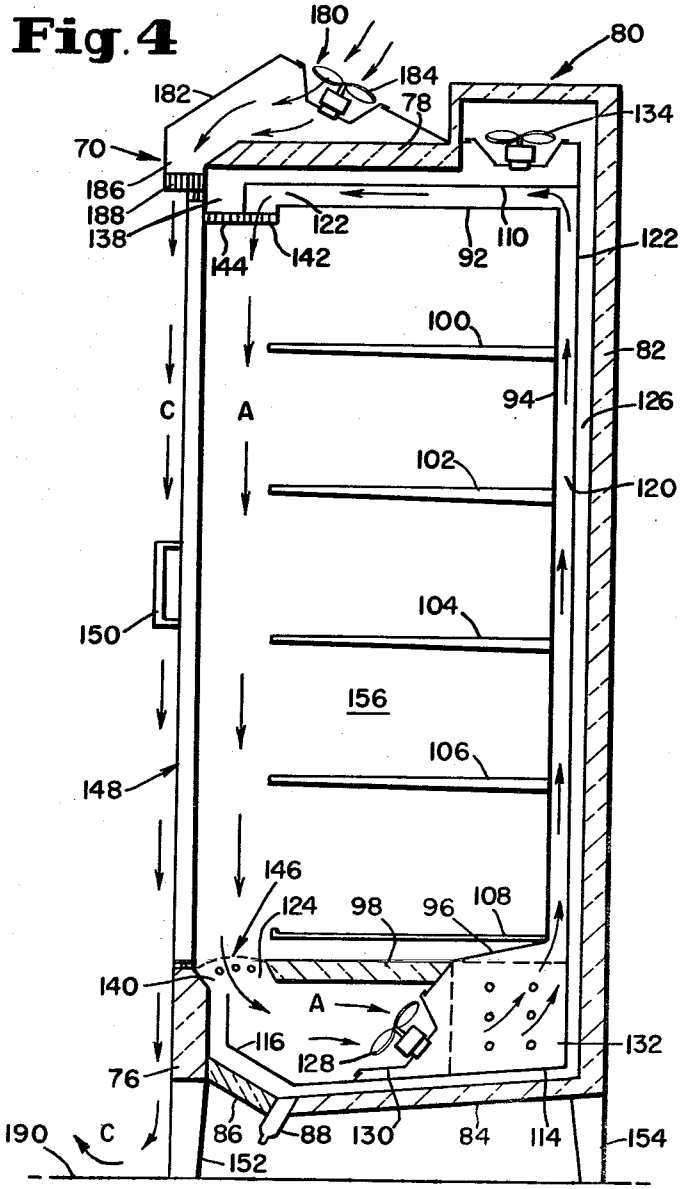
FIG. 4 is a side cross-sectional schematic view of a second embodiment of the refrigerated display cabinet of the present invention wherein three circulated air bands are employed together with a barrier door for the refrigerated display cabinet.
Figure 5:
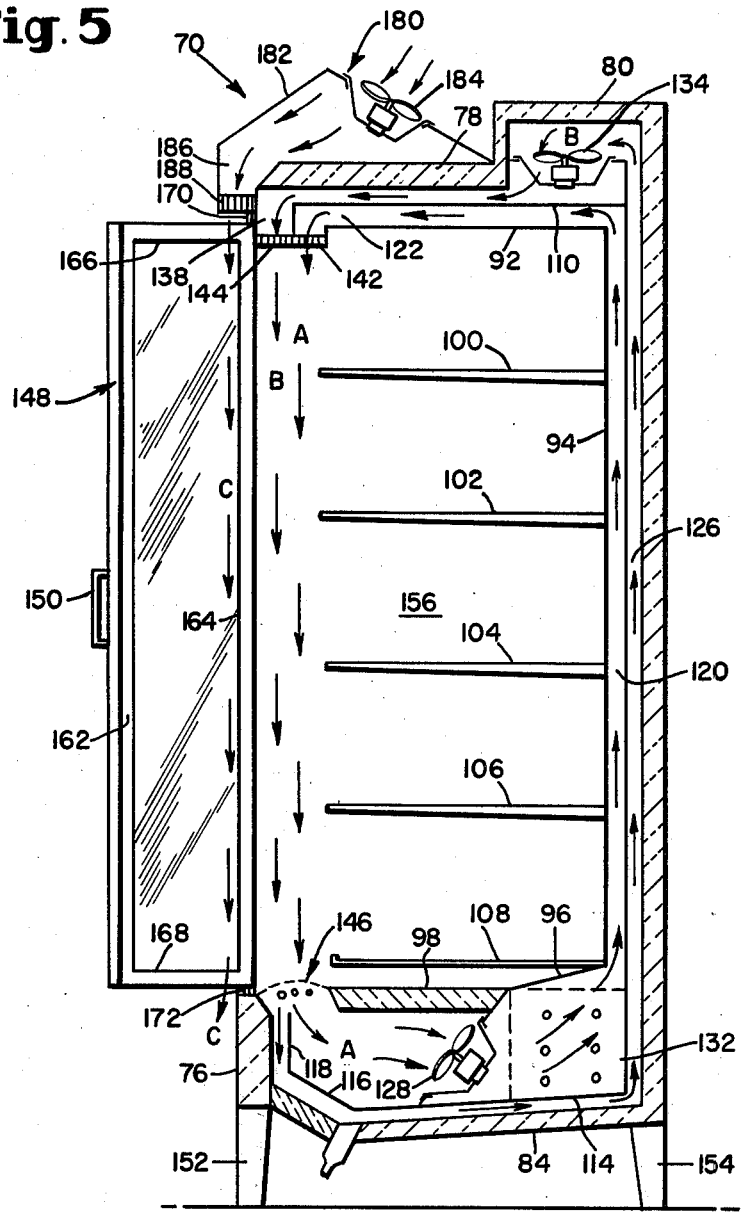
FIG. 5 is a schematic view of the refrigerated display cabinet illustrated in FIG. 4 showing the barrier door in an open position.

Referring now to FIGS. 4 and 5, an ambient air circulating means 180 is provided for display cabinet 70. This ambient air circulation means 180 is positioned on top of top wall 78 and contains a hood structure 182 which supports a motor-driven fan 184 in order to move ambient air through the hood structure 182 and through the ambient air outlet 186 and through downwardly directed louvers 188 across the front surface of door 148. The ambient air flow C so established flows across the front surface of door 148 and in front of lower front wall 76 before diffusing across the floor 190, as shown. The other elements of refrigerated display cabinet 70 are the same as shown in FIGS. 2 and 3 and hence, consistent numerals have been employed.

Control means are provided for the operation of refrigerated display cabinet 70 to operate the actuating means which activates the second air circulation means 134 for operation during opening of door 148. This control means also activates the ambient air circulating means 184 in two modes of operation. In one mode the ambient air flow C is caused to run continuously or intermittently depending upon various operating conditions detailed below when the door 148 is in closed position as shown in FIG. 4. Another mode of operation is that the control means can operate the ambient air circulating means 184 only during times when the door 148 is opened. In this second mode of operation both the second air circulation means 134 and the ambient air circulation means 184 are operated simultaneously by an actuating means which is responsive to the opening of the door 148. The second mode of operation is best illustrated in FIG. 5.

Referring now to FIGS. 6–9, an upright refrigerated display cabinet or case assembly 200 is designed with both a refrigerated air band and the protective guard air band of the present invention and an air defrost system in order to provide for better energy conservation. Display cabinet assembly 200 has a front wall 202, side walls 204, top wall 206 and an insulated rear wall 208 best shown in FIG. 7. Display cabinet 200 has an opening 210 in its front wall 202 which is covered by one or more barrier doors illustrated by five barrier doors 212, 214, 216, 218 and 220. Each door is attached to the display cabinet by vertical hinge pins and each door has a handle shown as 222, 224, 226, 228 and 230, respectively. Upper and lower bumper guard rails 229 and 231 are also provided on front wall 202. Such a refrigerated display cabinet is typically referred to as a glass-door merchandiser even though transparent material other than glass such as plastic can be used in the doors. Merchandiser refrigerated display cabinets can be used for storing either fresh foods, such as diary products, or frozen foods requiring lower temperatures.

Figure 6:
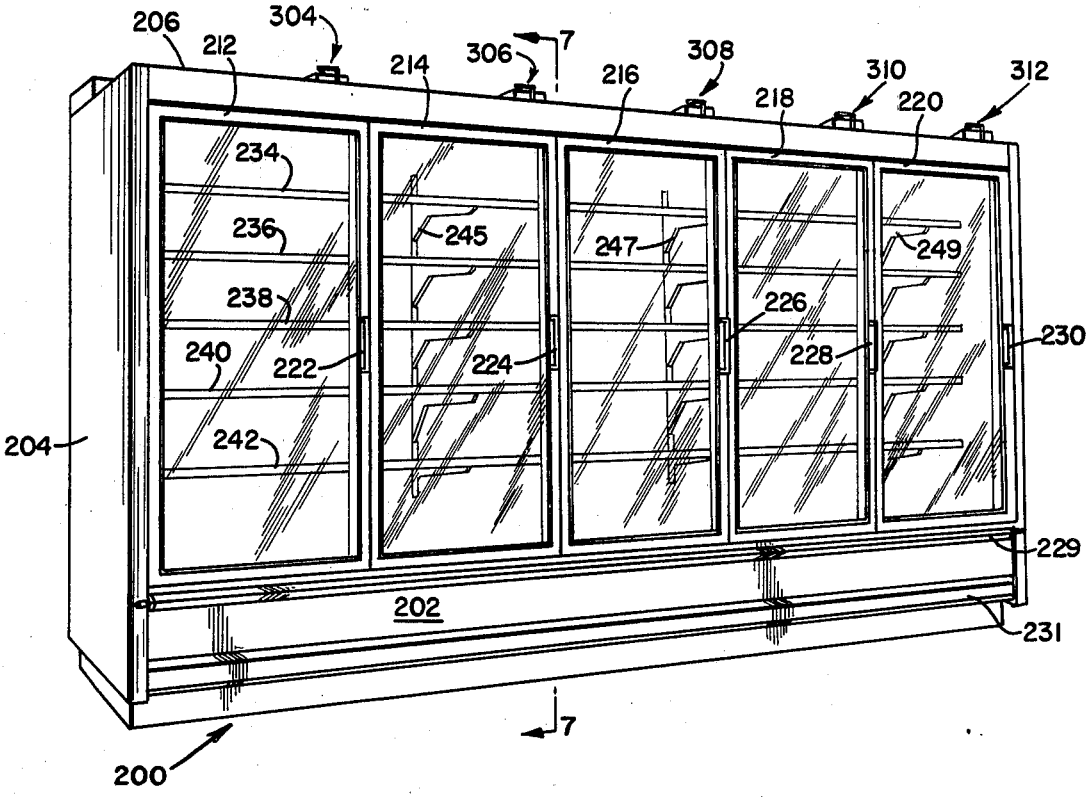
FIG. 6 is a perspective schematic view of a refrigerated display cabinet also showing door opening mechanisms for the air defrost means.
Figure 7:
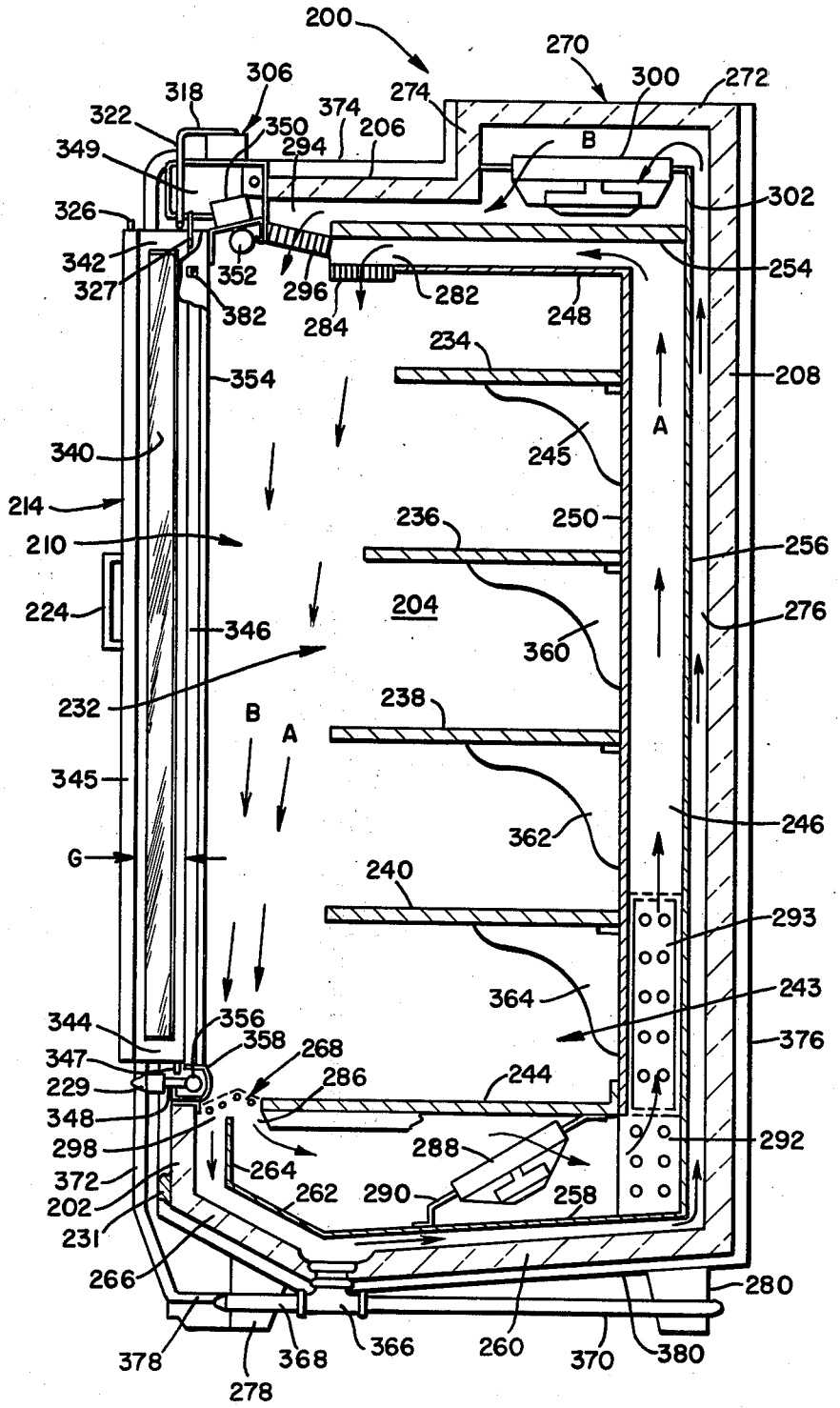
FIG. 7 is a detailed cross-sectional schematic view of the refrigerated display case illustrated in FIG. 6 taken on the line 7—7 when the barrier door is in an open position during the refrigeration cycle of operation.

The interior of the display cabinet shown in FIG. 7 has a display space 232 in which there are arranged a plurality of display shelves 234, 236, 238 and 240, although more than four such shelves can be employed as illustrated by shelf 242 in FIG. 6.

Each shelf can be supported by a plurality of vertically adjustable support brackets 245, 247 and 249 as shown for shelf 234 in FIG. 6. The space at the bottom of the shelves can be used as a storage space 243 for which a bottom panel 244 is provided as shown in FIG. 7. Access to the refrigerated products on the display shelves is provided to customers and employees by opening one or more of the doors and reaching into the case through access opening 210.

Disposed about display space 232 is a primary air conduit 246 which is formed on the interior side by top panel 248 rear panel 250 and bottom display panel 244 which also form the interior surfaces of display space 232. The primary air conduit 246 is formed on the exterior side by an upper divider panel 254 which is connected along the rear edge thereof to a vertical divider panel 256 which extends downwardly and parallel to rear panel 250. Both panels 250 and 256 are shown, constructed of sheet metal although laminates of metal, plastic, and insulation can be used. Vertical divider panel 256 is connected along the lower edge thereof to bottom separator panel 258 which extends above and is spaced away from bottom insulated panel 260. Bottom separator panel 258 is connected at the front edge thereof, as shown in FIG. 7, to an inclined front separator panel 262 which is, in turn, joined to a substantially vertical front divider panel 264. An inclined bottom member 266 is connected by the rear edge to the front edge of bottom panel 260 and at its front most edge with the bottom of front wall 202 which extends upwardly and provides front support for an air grille 268 which then extends from the front wall 202 in an arcuate fashion into bottom storage space 243.

The rear edge of bottom panel 260 is connected to rear wall 208. The top portion of rear wall 208 and part of top wall 206 incorporate a secondary air conduit fan housing 270 which is constructed of a top panel 272 connected along the top edge of rear panel 208 and along the front edge thereof to vertical exterior member 274 which is connected by the lower edge thereof to top panel 206. The outermost conduit formed between top wall 206 and upper divider panel 254 at the top of the cabinet and extending vertically downward between divider panel 256 and rear panel 208 forms a secondary air conduit 276 which then extends between bottom separator panel 258 and bottom panel 260 in the lower portion of the cabinet. Support feet 278 and 280 are also provided for cabinet 200.

Primary air conduit 246 terminates at its upper end in a primary conduit outlet opening 282 in which are arranged downwardly oriented directional louvers 284. At the opposite end of primary air conduit 246 an air inlet opening 286 is provided immediately below grille 268 and functions as an air intake for the primary air band as indicated by arrows A. Outlet opening 282 and inlet opening 286 are arranged in aerodynamic alignment for the primary air band. The primary air band A is circulated by motor-driven primary fan 288 which is supported in the bottom portion of primary conduit 246 by a baffle plate 290. Also positioned within conduit 246 are one or more evaporator coils of a refrigeration means indicated schematically as low temperature elements 292 and 293. These refrigeration means consist of sheet metal boxes in which a plurality of refrigeration evaporation coils are arranged. The sheet metal sides have openings to allow for passage of an air band as illustrated in the various figures by the air flow arrows and perforations. The primary air band propelled through conduit 246 by fan 288 is maintained in a refrigerated, low temperature condition during the refrigeration cycle of operation of cabinet 200.

The upper front portion of secondary air conduit 276 formed between upper separator panel 254 and top wall 206 terminates in a secondary air conduit outlet opening 294 in which are positioned downwardly oriented directional louvers 296 which function to direct the air flow downwardly in a parallel path to the inside of door 214 and to the outside of the primary air band A as shown by the secondary air guard band indicated by arrows B in FIG. 7. The secondary air band enters air grille 268 near the bottom portion of door 214 and then into a secondary conduit air inlet opening 298 which is associated with air grille 268. The inlet and outlet openings of the secondary air conduit are also positioned in aerodynamic alignment. This secondary air inlet opening is separated from the primary conduit inlet opening 286 by the top front portion of front divider panel 264. When door 214 is opened for product access during the refrigeration cycle of operation shown in FIG. 7 the secondary air band B is activated and propelled downward through the outlet opening 294 and into inlet opening 298 and then between front separator panel 262 and inclined bottom member 266 and thereafter between separator panel 258 and bottom panel 260 then upwardly in conduit 276 between vertical divider panel 256 and rear wall 208 by operation of motor-driven secondary conduit fan 300 mounted in baffle 302 positioned within fan housing 270 at the top of the case 200.

The counterclockwise flow of the secondary air band B when initiated by the opening of door 214 establishes a protective guard air band to the outside of the primary air band A which flows parallel and contiguous to the primary air band. The flow of the secondary air band B provides the advantageous energy conserving operation of refrigerated display cabinet 200 when the door is opened in accordance with the above description.

Another feature of the refrigerated display cabinet 200 shown in FIGS. 6–9 is the air defrost means in which a novel door opening mechanism is provided for use during a defrost cycle of operation. The purpose of the door opening mechanism is to create a gap G between the barrier door 214 and the access opening 210 in order to allow for ambient air through-flow in order to defrost and deice the evaporator coils 292 and 293 of the refrigeration means.

FIG. 6 shows door opening mechanisms 304, 306, 308, 310 and 312 connected on top wall 206. As will be appreciated from the later described functioning of these door opening mechanisms a single such mechanism could be arranged to operate all of the five doors shown for cabinet 200. In the specific embodiment shown in FIGS. 6 and 7, mechanism 306 is an electric motor and gear box which operates a linkage-rotating rod-lever system to open door 214.

Figure 8:
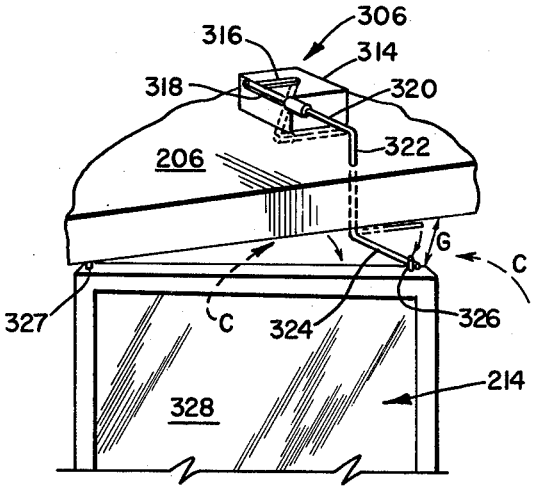
FIG. 8 is a perspective schematic view of a portion of the display cabinet shown in FIGS. 6 and 7, showing a detailed view of the door opening mechanisms which is a part of the air defrost system of the cabinet.

Door opening mechanism 306 is best shown in FIG. 8 wherein an electric motor and gear box 314 is mounted on top wall 206 and has a swing arm 316 attached to its output shaft. Arm 316 is pivotally linked at its opposite end to member 318 which is, in turn, pivotally linked to rod 320 which has a vertical portion 322 which passes through and is rotatably supported within top wall 206. The bottom of vertical portion 322 is integrally connected to an operator lever 324 which contacts the stud 326 secured to the top portion of door 214 as shown in FIG. 8. When door opening mechanism 306 is activated it moves from the closed position shown in dotted lines to the open position shown in solid lines so that door 214 is opened by reason of movement of operator lever 324 against stud 326. Operation of the motor in an opposite direction causes the door opening mechanism shown to return to closed position. Springs (not shown) can be included in connection with the door hinge pins or links 327 to assure prompt closure of door 214 which can preferably having a substantial area of transparent material such as glass or plastic shown as 328. An alternate configuration is that operator lever 324 can be bifurcated so that it straddles stud 326 and moves door 214 positively in both the opening and the closing directions. Another configuration for the door operating mechanism is that a plurality of solenoids can operate directly against the doors to open the same or a single solenoid operating a multiple cam arrangement can open all doors or only selected doors by use of rods and levers.

Figure 9:
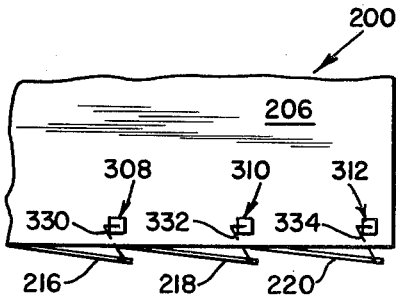
FIG. 9 is a top plan schematic view of the top right front portion of the refrigerated display cabinet shown in FIG. 6 which shows the door opening mechanisms of the air defrost means.

Door opening mechanism 306 and the associate arms, rods and linkages provide an air defrost means for selectively creating a gap between the barrier door 214 and the access opening 210. In the defrost cycle of operation of cabinet 200 ambient air is drawn into and/or expelled out of the cabinet 200 through the gap G. FIG. 9 shows three such door opening mechanisms 308, 310 and 312 and associate links 330, 332 and 334 for opening doors 216, 218 and 220, respectively.

Additional details of the refrigerated cabinet are illustrated in FIG. 7. Line 7—7 shown on FIG. 6 has been taken when door 214 is open. The door 214 consisting of an inside glass pane 340 and a corresponding outside pane supported by an upper frame member 342 and a lower frame member 344. The upper and lower frame members are connected by a front frame piece 345 and a rear frame piece 346. A bottom hinge pin 347 is shown for lower frame member 344 and a similar hinge pin 327 is provided for the upper frame member 342. The bottom hinge pin 347 is shown supported by the top portion of the lower light fixture bracket 348 mounted on front wall 202 and top hinge pin 327 is shown supported in top cowl 349, although intermediate door frame members can be used to provide this support. Stud 326 is secured to the top edge of the door frame member 342 of door 214 which is opened by door operating mechanism 306 and its associated rod and linkage mechanisms 316–324 during a defrost cycle as described in reference to FIG. 8.

Cabinet 200 as shown in FIG. 7 is equipped with an upper light fixture 350 which, typically, is arranged to accommodate a longitudinal series of fluorescent bulbs 352. A door frame mullion 354 is supported at its upper end by top cowl 349 and at its lower end by lower light fixture bracket 348 which is arranged to accommodate a fluorescent bulb 356 and a light guard 358 formed of a translucent material. The mullion 354 can be connected at upper and lower ends to intermediate door frame members (not shown which can also provide the hinge support for the cabinet doors). The vertical door frame mullion 354 is one of a plurality of such mullions spaced longitudinally across access opening 210. Thus this access opening is divided by this construction into a plurality of access openings which are then covered by a plurality of doors such as shown in FIG. 6.

Shelf support bracket 245 is shown attached to the underside of shelf 234. Brackets 360, 362 and 364 can be provided for shelves 236, 238 and 240, respectively.

The insulation layer in the bottom portion of front wall 202, bottom member 266, bottom panel 260 as well as back wall 208, secondary fan housing 270 and top wall 206 can be seen proceeding around the outer wall of cabinet 200 in a counterclockwise fashion. Also upper divider panel 254 is an insulated member.

If desired, additional vertical fluorescent lights can be attached to vertical mullions 354 to provide light for display space 232.

Separator panels 258, 262 and divider panel 264 are provided in the bottom space in cabinet 200 for separating the bottom portion of primary conduit 246 from secondary conduit 276. Vertical divider panel 256 is shown separating these two conduits 246 and 276 at the back portion of cabinet 200. Suitable longitudinally spaced support members are provided in construction of cabinet 200 for securing these and other described panels in the various embodiments in affixed relationship to one another along the cabinet length shown in FIG. 6.

Bottom drain 366 can be of inverted T-type configuration as shown in FIG. 7 and attached to a closable front pipe 368 and a rear pipe 370 provided for connection to drainage lines. An end panel trim member 372 is shown attached to the outer edges of end panel 204 at the front side thereof. A top trim member 374 is shown attached to the far end of top wall 206. Another trim member 376 is provided for the back edge of end panel 204. Bottom trim members 378 and 380 are also provided. The bumper guard rails 229 and 231 are shown at the lower portion of the front part of cabinet 200.

Also shown in FIG. 7 at the top cut-away portion is an operator switch 382 positioned against vertical door mullion 354 and designed to be contacted by the rear vertical door frame piece 346 as door 214 is closed during use. This operator switch can be used to record door openings for the purpose of controlling the actuating means for operation of secondary fan 300 in accordance with the above-described modes of operation.

Figure 10:
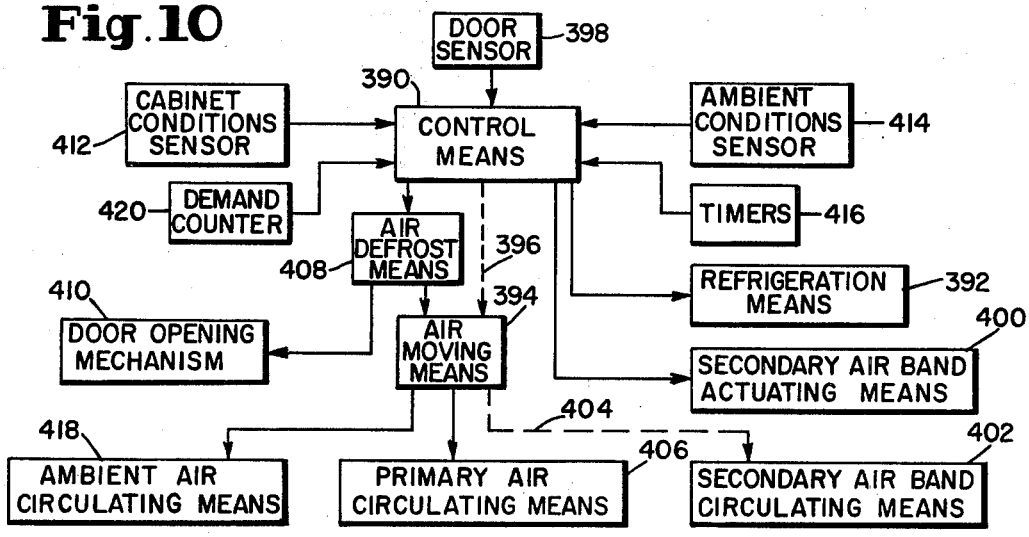
FIG. 10 is a schematic diagram of the control means hierarchy involved in the operation of the refrigeration display cabinet.

Referring to FIG. 10, a block diagram of the control means hierarchy is set forth. Refrigerated display cabinets conventionally have control means 390 for operating refrigeration means 392, and air moving means 394. A dashed control line 396 is shown denoting control of both defrost and refrigeration cycles. In accordance with the present invention, refrigerated display cabinets 70 and 200 described with respect to FIGS. 2–9 are provided with door sensors illustrated as block 398 which are arranged for detecting opening and closing of the barrier doors. The signals are fed into the control means 390 which, in turn, control the secondary air band actuating means 400 in order to activate the secondary air band during times when barrier doors are opened. The actuating means 400 then provides an intermediate control for secondary air band circulating means 402 which is illustrated in the various figures as the secondary air conduit fan 134 in FIGS. 2–5 and as fan 300 in FIGS. 6–9.

Air moving means 394 also has a control linkage to the secondary air band circulating means 402, shown by a dashed control line 404 which is used during defrost cycle when the secondary air band is used to circulate ambient air into contact with the evaporator coils. Air moving means 394 also controls the primary air circulating means 406 and is in turn controlled by air defrost means 408 during defrost cycles. The control means 390 provides dominating control for the air defrost means 408 since the latter means is operated only during a defrost cycle. Hence, control means 390 switches operation of the refrigerated display cabinet between a refrigeration cycle in which refrigeration means 392 is employed and a defrost cycle operation in which the air defrost means 408 is employed. A door opening mechanism 410 illustrated in FIG. 7 as door opening mechanism 306 is controlled by the air defrost means 408 in the manner above set forth.

Other devices such as cabinet condition sensors 412, ambient condition sensors 414, and timers 416 can be employed in order to determine the switching of the refrigeration and the defrost cycles of operation. The ambient air circulating means 418 is also controlled by air moving means 394. Control of the ambient air circulating means and the secondary air band actuating means 400 can be summarized within control means 390 so that both sets of circulation equipment are activated upon opening of the barrier doors as recorded by the door sensor 398. If desired, the control means 390 can have an additional input from a demand counter circuit 420 in which the number of door openings during programmed time periods can be recorded back into control means 390. In this manner, the secondary air band actuating means can be activated only in response to a specific number of openings during a period of time rather than activated upon each opening of the barrier door. In this way, infrequent openings of the barrier doors will not cause the secondary air band circulating means 402 to operate since the heat load therefrom can be adequately tolerated at a lower energy consumption by the refrigerated display case without the secondary band activation.

The internal circuitry used within the various blocks in FIG. 10 need only be consistent with the above description and the other modes of operation as set out below in order to control the power used by various operating elements within the refrigerated display case. The refrigeration means 392 includes conventionally functioning compressor, condensor, receiver, expansion valve and evaporator coil sets arranged in a refrigeration circuit.

MODES OF DEFROST OPERATION

The defrost cycle for the refrigerated display cabinets 70 and 200 described with reference to FIGS. 2–10 can operate in a number of ways. One way is to utilize electric resistance heaters or warm refrigerant fluid lines located adjacent to and in contact with the evaporator coils 132, 292 and 293 in the various figures described above. The heat transfer from these heater elements can be controlled by the control means 390 shown in FIG. 10.

A preferred defrost operation is to provide for the circulation of ambient air through the air conduits of the refrigerated display cabinets for contacting the frost and ice on the evaporator coils with warm ambient air in order to defrost the same in a lower energy consumption manner. The various cabinet and ambient condition sensors and timers described with respect to FIG. 10 can be used to determine the initiation of a defrost cycle. When a defrost cycle is initiated, the air defrost means 408 controls door opening control mechanism 410 to open one or more of the barrier doors of FIGS. 6–9 in order to permit the through-flow of ambient air. At the same time the air moving means 394 controls operation of the air circulating fans to move the ambient air through the air conduits and into contact with the evaporator coils. At the termination of the defrost cycle the air defrost means controls the door operating mechanisms such as 304, 306, 308, 310 and 312 of FIG. 6 to close the doors and the air circulation fan to revert the refrigeration operation. The control means 390 then takes over operations and activates the refrigeration means 392. The modes of defrost operation can be controlled by conventional electronic components, although arrangement of these components can result in several degrees of freedom in the operation of the cabinet. The control means can function during the refrigeration cycle as described and claimed herein wherein the secondary air band is activated in response to one or more openings of the barrier doors. Another variation is that the operation of the secondary air circulating means can be made additionally dependent upon the temperature and humidity conditions in the ambient store air or in the cabinet display space. The ambient air guard band can be similarly controlled although it is preferred to have this band activated during the refrigeration cycles.

The defrost cycle of operation for the refrigerated display cabinet can be initiated by sensing the temperature at locations spaced slightly away from the evaporator coils so that the build-up of a predetermined thickness of frost and ice on the coils will activate the sensing element which can then initiate a defrost cycle.

Another means to activate the defrost cycle is to use a timer which controls the defrost cycle initiation at set intervals. Other variations are to record store ambient conditions, particularly relative humidity, and to vary the time cycle of defrost depending on such conditions. The number of openings of the cabinet doors can also be included as a control feature as provided for by demand counter circuit 420.

The operation of the air circulating fans 128, 134, 184, 288 and 300 establish the counterclockwise flow of air bands A and B as illustrated in FIGS. 2–9 during the refrigeration cycle of operation. These fan means can be utilized in the same direction of air flow or in reverse direction air flow in order to accommodate air defrosting of the refrigerated cabinet during the defrost cycle of operation.

A preferred mode of defrost operation is to open the barrier door by a door opening mechanism such as 306 shown in FIG. 8 and to terminate circulation in the secondary air band by stopping the secondary fan 300 as shown in FIG. 7. Thereafter, the operation of the primary air band fan 288 is reversed and ambient air C is drawn into the refrigerated cabinet 200 near the top portion of the opened door 214 as shown in FIG. 8. This ambient air is then circulated in the primary conduit 246 and into contact with evaporator coil boxes 293 and 292, in order of contact with the clockwise air flow established. The ambient air then is moved by the primary air fan 288 in a reverse direction from that shown in FIG. 7 through the bottom portion of the cabinet upwardly through air grille 268 and out of the refrigerated cabinet by passage out of the gap G established between the barrier door 214 and the access opening 210. This type of air defrost provides for a low energy defrost mode since only a single air fan is employed.

If desired, the above-described air defrost mode of operation can be enhanced slightly for the modification shown in FIG. 5 wherein the ambient circulating fan 184 is also employed during a defrost cycle of operation in order to force ambient air through the top-most portion of gap G where it is then taken in by the primary air band flowing in reverse direction.

Also, another modification is to employ an air deflecting means between the secondary air conduit 276 and the primary air conduit 246 of FIG. 7 in the manner illustrated in U.S. Pat. No. 4,144,720 issued to Subera, et al in order to allow the employment of the secondary fans 134 and 300 in FIGS. 2–9 to additionally increase the flow of ambient air into the primary band. In this modification, the primary air band A is maintained in its counterclockwise direction of flow in both the refrigeration and in the defrost cycle.

If desired, a 25 to 50 percent greater air flow during defrost can be employed by increasing the speed of the air circulating fan and/or by arranging the pitch of the fan blades to move a greater volume of air in the defrost direction than in the refrigeration direction of air flow. The water formed during the defrost action is drained away from the cabinets by the bottom drains 88 and 366 illustrated in FIGS. 2–5 and 7, respectively.

A plurality of conduit fans illustrated by the primary conduit and second conduit fans shown in FIGS. 2–5 and 7 are spaced along the length of the cabinets 70 and 200. For example, two each of the primary and secondary fans are normally provided for in an eight foot long cabinet or case or three of each of these fan sets are provided for a twelve foot cabinet. By way of example, but not limitation, the overall height of cabinet 70 is approximately 82 inches and the width is approximately 45 inches. Such cabinets are manufactured in lengths up to 72 feet.

During the defrost cycle of operation, the door opening mechanism can operate according to any of several degrees of freedom:

(1) All doors can be opened simultaneously;

(2) Those doors having high customer demand can be more frequently opened for defrost since the closest spaced evaporator coil will accumulate more frost and ice;

(3) Individual doors or selected sequences such as alternate doors in the plurality of doors can be opened for defrost cycle;

(4) The doors can be opened a predetermined gap distance such as one to seven inches by way of preferred example or by a variable gap distance depending upon defrost conditions and ice accumulation;

(5) The defrost cycle initiation and gap creation by the air defrost means can be controlled by the need for defrosting as determined by frost and ice build-up sensed on the evaporator coils.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. In a display cabinet having refrigeration means and a display space therein, aperture means in at least one wall of said cabinet, said aperture means including an access opening for permitting products to be moved into and out of said display space, a first air circulating means for moving a primary air band within said cabinet about said display space and into contact with said refrigeration means during a refrigeration cycle, covering means for said aperture means including at least one barrier door for substantially covering a portion of said access opening, a first air band conduit arranged about said display space for containing said primary air band, said conduit arranged to establish a refrigerated primary air band along a path inside of said barrier door, and a second air band conduit arranged about said first air band conduit for containing a secondary air band, said second conduit arranged to establish a secondary guard air band curtain along a path contiguous to and outside of said primary air band over said access opening; the improvement comprising:

a second air circulating means for moving said secondary air band; and, actuating means for selectively activating said second air circulating means responsive to the opening of said barrier door.

2. The improvement according to claim 1, wherein a plurality of barrier doors are provided for substantially covering said access opening, and wherein each of said barrier doors operates an actuating means for selectively activating said second air circulating means to establish a secondary guard air curtain outside of said primary air band over that portion of said primary air band exposed to ambient air by the opening of said barrier doors.

3. The improvement according to claim 2, wherein said actuating means includes a series of contact switches positioned to be activated by the opening of individual doors.

4. The improvement according to claim 1, further comprising means for establishing an ambient air band along the outside of said guard air curtain at least during operating periods when said barrier door is opened.

5. The improvement according to claim 4 wherein said means for establishing an ambient air band moves ambient air over the outside of said barrier door when in closed position for transferring heat into said door to reduce moisture condensate thereon.

6. The improvement according to claim 1, wherein a control means includes sensor means for detecting the opening of said barrier door and wherein said control means operates said second circulating means through said actuating means for selectively propelling said secondary air band in the same direction as said first air band in response to the opening of said barrier door.

7. The improvement according to claim 6, wherein said control means selectively operates said second air band circulating means in response to a predetermined number of openings of said barrier door.

8. The improvement according to claim 1, wherein ambient air passage means are provided to enable contacting of said refrigeration means by ambient air in order to defrost the same during a defrost cycle of operation.

9. The improvement according to claim 1, further comprising means for opening said barrier door during a defrost cycle of operation so that ambient air can be moved through said display cabinet and into contact with said refrigeration means to defrost the same.

10. The improvement according to claim 1, wherein heat transfer means are positioned contiguous to said refrigeration means for operation during a defrost cycle of operation in order to remove frost and ice therefrom.

11. The improvement according to claim 10, wherein said heat transfer means comprises an electric resistance heater.

12. The improvement according to claim 10, wherein said heat transfer means comprises a warm refrigerant fluid line.

13. The improvement according to claim 1, wherein said secondary air band is circulated at a temperature of between 10° F. to 40° F. when said barrier door is opened.

14. The improvement according to claim 1, wherein said access opening is divided into a plurality of openings and barrier doors are provided for substantially covering each of said openings, said second air circulating means comprising a plurality of air moving means positioned within said second air band conduit along the length of said display cabinet, and said actuating means comprising a plurality of actuation elements arranged for individual activation by movement of each of said barrier doors for selectively activating said air moving means closest spaced to each of said barrier doors for establishing a guard air curtain outside of said primary air band over each of said plurality of openings when the covering barrier door associated with said opening is opened.

15. The improvement according to claim 1, wherein said barrier door is retrofitted into relationship with said access opening by means of interposed door frame means.

16. The improvement according to claim 1, wherein a plurality of barrier doors are provided for substantially covering said access opening and wherein said doors are retrofitted into relationship with said access opening by means of interposed door frame means.

17. The improvement according to claim 1, wherein an air defrost means is provided for selectively creating a gap between said barrier door and said access opening, said air defrost means causing said first and said second air circulating means to pass ambient air through said cabinet and through the gap between said barrier door and said access opening during a defrost cycle to bring ambient air into contact with said refrigeration means to remove frost therefrom and to thereafter eject the defrost ambient air from said cabinet.

18. The improvement according to claim 17, wherein control means is provided for selectively operating said air defrost means and said refrigeration means to terminate operation of and to defrost said refrigeration means during a defrost cycle and to refrigerate said display cabinet during a refrigeration cycle.

19. The improvement according to claim 17, wherein said aperture means includes an air passage port in a wall of said cabinet, and wherein said first and said second air circulating means pass ambient air through said cabinet by moving air through said air passage port and through the gap between said barrier and said access opening during a defrost cycle.

20. The improvement according to claim 17, wherein during a defrost cycle said air defrost means creates the gap between said barrier door and said access opening and causes said first and said second air circulating means to draw ambient air into said cabinet through a first portion of said gap and to eject the defrost ambient air through a second portion of said gap.

21. The improvement according to claim 1, wherein said second air circulating means propels said secondary guard air band in the same direction as said primary air band during a refrigeration cycle, and wherein said second air circulating means draws ambient air into said second air band conduit and then propels the ambient air through said cabinet in a reverse direction to the direction of said primary air band and into contact with said refrigeration means during a defrost cycle of operation.

22. The improvement according to claim 21, wherein said cabinet includes an air guidance means for deflecting at least a portion of said secondary air band into said primary air band during the reverse direction air flow in a defrost cycle.

23. The improvement according to claim 22, wherein said guidance means deflects substantially all of said secondary air band into said primary air band.

24. The improvement according to claim 1, wherein an air defrost means is provided for selectively creating a gap between said barrier door and said access opening, said air defrost means causing said first air circulating means to pass ambient air through said cabinet and through the gap between said barrier door and said access opening during a defrost cycle to bring ambient air into contact with said refrigeration means to remove frost therefrom and to thereafter eject the defrost ambient air from said cabinet, said air defrost means selectively reversing the direction of flow of said primary air band and terminating operation of said refrigeration means and terminating operation of said second air circulating means during a defrost cycle to prevent flow of said secondary air guard band whereby ambient air is passed through said cabinet by said first air circulating means during a defrost cycle of operation.

25. The improvement according to claim 1, wherein a control means is provided including means for sensing the refrigeration condition within said display case and wherein said actuating means is selectively operated to propel said secondary guard air band in the same direction as said primary air band depending upon the refrigeration condition sensed.

26. The improvement according to claim 1, further comprising means for establishing an ambient air band along the outside of said secondary guard air band selectively in response to the opening of said barrier door.

27. The improvement according to claim 1, wherein during a defrost cycle of operation said first air circulating means is caused to reverse the flow of said primary air band from the direction of flow during a refrigeration cycle of operation and to discharge defrost ambient air through a portion of said aperture means other than said access opening.

28. The improvement according to claim 1, wherein during a defrost cycle of operation said first air circulating means is caused to reverse the flow of said primary air band from the direction of flow during a refrigeration cycle of operation and to discharge defrost ambient air through a gap created between said barrier door and said access opening.

29. The improvement according to claim 1, wherein an air defrost means is provided for selectively creating a gap between said barrier door and said access opening, said air defrost means causing said first air circulating means to pass ambient air through said cabinet and through the gap between said barrier door and said access opening during a defrost cycle to bring ambient air into contact with said refrigeration means to remove frost therefrom and to thereafter eject the defrost ambient air from said cabinet, and wherein said cabinet further comprises means for establishing an ambient air band along the outside of said primary air band during a defrost cycle of operation for comingling the ambient air with said primary air band whereby said refrigeration means is contacted by said primary air band containing ambient air.

30. The improvement according to claim 1, wherein said second air band conduit is arranged adjacent to a substantial portion of said first air band conduit, and said second air band conduit is connected at an inlet end thereof to said first air band conduit, said first and said second air band conduits being separated along the length thereof from said second air band conduit inlet to the outlet end thereof, said cabinet including a common conduit inlet chamber for said primary and said secondary air bands, wherein during a refrigeration cycle of operation said first air circulating means propels said primary air band within said first air conduit and through said common conduit inlet portions and, and wherein during a defrost cycle of operation said first air circulating means reverses the flow direction of said primary air band to draw ambient air into said cabinet through said aperture means and into contact with said refrigeration means for defrosting.

31. The improvement according to claim 30, wherein said second air circulating means is operative during a refrigeration cycle of operation in response to the opening of said door, and wherein said second air circulating means propels said secondary air band in a direction opposite to the direction during a refrigeration cycle when said cabinet is operated in a defrost cycle to assist said primary air band to draw ambient air into said cabinet and into contact with said refrigeration means for defrosting.

32. The improvement according to claim 1, wherein air defrost means is provided for selectively creating a gap between said barrier door and said access opening for passing ambient air through said cabinet during a defrost cycle of operation, and wherein said air defrost means comprises a door operating mechanism for selectively creating a gap between said barrier door and said access opening.

33. The improvement according to claim 1, wherein a plurality of barrier doors are provided for substantially covering said access opening, and wherein air defrost means are provided for selectively creating a gap between said barrier door and said access opening and comprises a series of door operating mechanisms arranged for individually and selectively creating a gap between at least two of said barrier doors and said access opening during a defrost cycle.

34. A refrigerated display cabinet having top, bottom, rear and front walls and an interior display space, with an access opening in said front wall for enabling access into said interior display space comprising:

at least one barrier door covering said access opening in said front wall, said door being movable into an open position for enabling access to products in said interior display space;

a first air band conduit extending along said top, bottom and rear walls and having an outlet opening and an inlet opening at opposing ends thereof, said outlet opening and said inlet opening being arranged so that air leaving said outlet opening will be directed toward and received by said inlet opening so as to form a refrigerated primary air band across said front opening along a path inside of said door;

first air circulating means for circulating said primary air band through said first air band conduit;

refrigeration means including an evaporator coil arranged within said first air band conduit for refrigerating air circulated through said conduit during a refrigeration cycle of operation;

a second air band conduit extending about said first air band conduit and having an outlet opening and an inlet opening respectively adjacent to said outlet opening and said inlet opening of said first air band conduit for directing air across said access opening along a path outside of said primary air band so as to form a secondary guard air band curtain;

second air circulating means for circulating air through said second air band conduit; and, actuating means for selectively actuating said second air circulating means for operation during a refrigeration cycle responsive to the opening of said door.

35. A refrigerated display cabinet according to claim 34, further comprising means for establishing an ambient air flow along the outside of said door when said door is in closed position.

36. A refrigerated display cabinet according to claim 34 or 35, further comprising control means for switching said refrigerated display case into a defrost cycle of operation and during such defrost cycle said control means temporarily turning off said refrigeration means and causing ambient air to be circulated through said first air band conduit.

37. A refrigerated display cabinet according to claim 36, wherein said control means causes said first air circulating means to circulate ambient air through said first air band conduit in a direction opposite to the direction of air flow during a refrigeration cycle of operation.

38. A refrigerated display cabinet according to claim 36, wherein during a defrost cycle of operation said control means causes said second air band circulating means to draw ambient air into said secondary air conduit so as to flow in a direction opposite the direction of air flow during a refrigeration cycle of operation and wherein said first air circulating means maintains a flow of air in the same direction during a defrost cycle of operation as during a refrigeration cycle of operation and further comprising means for diverting ambient air from said second air band conduit into said first air band conduit during a defrost cycle of operation.

39. A refrigerated display cabinet according to claim 36, wherein said control means causes both said first air circulating means and said second air circulating means to draw ambient air through said first air band conduit and said second air conduit during a defrost cycle of operation in a direction that is opposite to the direction of air flow during a refrigeration cycle of operation.

40. A refrigerated display cabinet according to claim 34, further comprising means for opening said door during a defrost cycle of operation so that said air circulating means can draw in ambient air from outside of said display case during the defrost cycle of operation.

41. A refrigerated display cabinet according to claim 34, further comprising means for opening said door during a defrost cycle of operation so that both said first air circulating means and said second air circulating means can draw in ambient air for circulation through said first air band conduit and said second air band conduit during a defrost cycle of operation.

42. A refrigerated display cabinet according to claim 36, further comprising means for opening said door during a defrost cycle of operation and said control means enabling reversal of the direction of flow through said first air band conduit, the causing said first air circulating means to draw ambient air into said first air band conduit and the termination of operation of said second air circulating means.

43. A refrigerated display cabinet according to claim 34, wherein a plurality of barrier doors are provided for substantially covering said access opening, and wherein each of said barrier doors operates a separate actuating means for selectively activating said second air circulating means to establish a secondary guard air curtain outside of said primary air band over that portion of primary air band exposed to ambient air by opening of said barrier doors.

44. A refrigerated display cabinet according to claim 43, wherein said actuating means includes a series of contact switches positioned to be activated by the opening of individual doors.

45. A refrigerated display cabinet according to claim 34, wherein a control means is provided with detector means for detecting the opening of said barrier door and wherein said control means operates said second air circulating means through said actuating means for selectively propelling said secondary air band in the same direction as said first air band in response to the opening said barrier door.

46. A refrigerated display cabinet according to claim 45, wherein said control means selectively operates said second air band circulating means in response to a predetermined number of openings of said barrier door.

47. A refrigerated display cabinet according to claim 34, wherein heat transfer means are positioned contiguous to said evaporator coil for operation during a defrost cycle in order to remove frost and ice therefrom.

48. A refrigerated display cabinet according to claim 47, wherein said heat transfer means comprises an electric resistance heater.

49. A refrigerated display cabinet according to claim 47, wherein said heat transfer means comprises a warm refrigerant fluid line.

50. A refrigerated display cabinet according to claim 34, wherein said secondary air band is circulated at a temperature within said display cabinet of between 10° F. to 40° F. when said door is opened.

51. A refrigerated display cabinet according to claim 34, wherein said barrier door is retrofitted into relationship with said access opening by means of interposed door frame means.

52. A refrigerated display cabinet according to claim 34, wherein a plurality of barrier doors are provided for substantially covering said access opening and wherein said doors are retrofitted into relationship with said access opening by means of interposed door frame means.

53. A method of operating a refrigerated display cabinet comprising a cabinet having a display space therein, an aperture means in at least one wall thereof, the aperture means including an access opening for permitting products to be moved into and out of the display space, a first air circulating means for moving a primary air band within the cabinet about the display space and into contact with a refrigeration means during a refrigeration cycle, covering means for the aperture means including at least one barrier door for substantially covering a portion of the access opening, a first air band conduit arranged about the display space for containing the primary air band, the first air conduit arranged to establish a refrigerated primary air band along a path inside of the barrier door, and a second air band conduit arranged about the first air conduit for containing a secondary air band, the second air conduit arranged to establish a secondary guard air band curtain along a path contiguous to and outside of the primary air band, a second air circulating means for moving the secondary air band, and actuating means for controlling operation of the secondary air circulating means; the method comprising the steps of:

operating the first air circulating means to establish a refrigerated primary air band during a refrigeration cycle of operation, operating the second air circulating means through the actuating means responsive to the opening of the barrier door to establish a secondary guard air band curtain outside of the primary air band in order to protect the primary air band from contact with ambient air when the barrier door is opened.

54. A method according to claim 53, wherein the second air circulating means remains inoperative whereby the secondary air band is not circulated when the barrier door is closed.

55. A method according to claim 53, including the additional step of causing ambient air to flow downwardly in a path contiguous to the outside surface of the barrier door when in closed position and in contact with the primary air band when the barrier door is in open position.

56. A method according to claim 53, including the additional step of operating the actuating means for selectively activating the second air circulating means to establish a secondary guard air curtain outside of the primary air band over that portion of the primary air band exposed to ambient air by opening of the barrier door.

57. A method according to claim 53, wherein a plurality of barrier doors are provided for substantially covering the access opening including the additional step of operating separate actuating means by each of the barrier doors for selectively activating the second air circulating means to establish a secondary guard air curtain ouside of the primary air band over that portion of the primary air band exposed to ambient air by opening of the barrier doors.

58. A method according to claim 53, including the additional steps during a defrost cycle of operation of, terminating operation of the refrigeration means, causing ambient air to be drawn into the cabinet, pass through a substantial portion of the first air band conduit, and come into contact with the refrigeration means, and to thereafter be ejected from the cabinet.

59. A method according to claim 58, including the additional step of terminating operation of the second air circulating means during the defrost cycle of operation.

60. A method according to claim 58, wherein means are included in the cabinet for diverting ambient air from the second air band conduit into the first air band conduit during a defrost cycle of operation and including the additional step drawing ambient air into the second air band conduit by operation of the second air circulating means, moving the ambient air through the second air band conduit, diverting the ambient air into the first air band conduit, and expelling the defrost ambient air from the display cabinet after contact with the refrigeration means.

61. A method according to claim 53, including the additional step of creating a gap between the barrier door and the access opening to enable ambient air through-flow within the cabinet to defrost the refrigeration means thereof.

* * * * *